United States Patent [19]

Miller et al.

[11] Patent Number: 4,541,798

[45] Date of Patent: Sep. 17, 1985

[54] POST-MIXED SPARK-IGNITED BURNER

[75] Inventors: Raymond H. Miller, Hopewell Junction, N.Y.; Richard B. VanKempema, Highbridge, N.J.

[73] Assignee: Union Carbide Corporation, Danbury, Conn.

[21] Appl. No.: 549,496

[22] Filed: Nov. 7, 1983

[51] Int. Cl.[4] ..... F23Q 3/00

[52] U.S. Cl. ..... 431/266

[58] Field of Search ..... 431/255, 264–266, 431/254; 313/130; 361/253, 261

[56] References Cited

U.S. PATENT DOCUMENTS

| | | | |
|---|---|---|---|
| 2,865,441 | 12/1958 | Coupe | 158/28 |
| 2,880,792 | 4/1959 | Raskin | 431/266 |
| 2,996,113 | 8/1961 | Williams | 158/115 |
| 3,558,251 | 2/1969 | Bauger et al. | 431/266 |
| 3,880,571 | 4/1975 | Koppang et al. | 431/8 |
| 3,905,751 | 9/1975 | Hemsath | 431/183 |
| 4,181,491 | 1/1980 | Hovis | 431/187 |
| 4,378,205 | 3/1983 | Anderson | 431/5 |
| 4,391,582 | 7/1983 | Cowan | 431/266 |
| 4,431,400 | 2/1984 | Kobayashi et al. | 431/266 X |

FOREIGN PATENT DOCUMENTS

| | | | |
|---|---|---|---|
| 421854 | 8/1974 | U.S.S.R. | 431/266 |

*Primary Examiner*—Margaret A. Focarino
*Attorney, Agent, or Firm*—Stanley Ktorides

[57] ABSTRACT

An assembly for a post-mixed burner wherein an inner conduit is electrified, is electrically isolated from a concentric housing and securely fixed relative thereto, with the simultaneous prevention of inadvertent fuel and oxidant mixing and prevention of outside forces disturbing the positioning of the inner conduit.

6 Claims, 2 Drawing Figures

POST-MIXED SPARK-IGNITED BURNER

TECHNICAL FIELD

This invention relates generally to post-mixed burners which are ignited by a spark caused by electrical discharge and, in particular, to post-mixed burners having concentric fuel and oxidant passages.

BACKGROUND ART

A recent significant advancement in the field of post-mixed spark-ignited burners is the development of an ignition system wherein the burner itself comprises the sparking means. This ignition system is described and claimed in U.S. Pat. No. 4,431,400, issued Feb. 14, 1984. In this ignition system a conduit carrying fuel or oxidant is electrically conductive and electrically isolated from another conduit carrying the fluid not carried by the first conduit. Both conduits end at the discharge end of the burner and are arranged such that the point of lowest breakdown voltage between them is also at the discharge end. When electrical potential is applied, a spark discharges between the two conduits at the discharge end igniting the fuel and oxidant.

The above-described ignition system is very safe and reliable as well as being relatively simple to manufacture and maintain. However this ignition system mandates a number of aspects which require precision or else the ignition system will fail to work properly resulting in the loss of safety, reliability and/or simplicity.

First, the two conduits must at all points be electrically isolated from one another and the point of lowest breakdown voltage must at all times be at the burner discharge end. This requires that the position of the two conduits relative to one another, both axially and radially, be fixed. Any significant movement of one conduit relative to the other may cause spark to form at other than the burner discharge end. Movement may be caused by external force such as may be applied by the supply conduits. This problem of rigid relative fixation combined with total electric isolation is more difficult when the conduits are concentric, i.e., when one conduit is within the other conduit.

Second, the central conduit must be able to be supplied with fluid without compromising either its electrical isolation or its physical position. It is also desirable that the central conduit be supplied with electrical potential so that spark arcs from the central to the outer conduit and all exposed outer housing be electrically grounded to minimize any safety hazard to the burner operator. Thus the central conduit must be able to be supplied with electricity without compromising either its electrical isolation or its physical position.

Third, the burner being a post-mixed burner wherein the fluid in the central conduit must not mix with the fluid in the outer or annular conduit until they are both discharged out the discharge end of the burner, the fluid must be supplied to the central conduit such that mixture with fluid in the annular conduit is prevented while maintaining the required electrical isolation and physical positioning.

Fourth, the burner assembly to satisfy the above-described requirements should be relatively simple. A complicated system would negate the benefits of the simplicity of the aforementioned ignition system. A complex assembly would also make periodic disassembly of the burner for cleaning or parts replacement an unduly time consuming and expensive task.

It is therefore an object of this invention to provide an assembly for a post-mixed spark-ignited burner which effectively electrically isolates a central conduit from an annular conduit.

It is another object of this invention to provide an assembly for a post-mixed spark-ignited burner which effectively fixes the position of the central conduit relative to the annular conduit.

It is a further object of this invention to provide an assembly for a post-mixed spark-ignited burner wherein the central conduit is effectively supplied with fluid and with electrical potential without compromising the required electrical isolation and physical positioning.

It is a still further object of this invention to provide an assembly for a post-mixed spark-ignited burner wherein fluid intended to flow through the central conduit is effectively prohibited from mixing with fluid intended to flow through the annular conduit until they are both discharged from the discharge end of the burner.

It is yet another object of this invention to provide an assembly for a post-mixed spark-ignited burner which effectively accomplishes the above-described objects while also being relatively simple and which allows for facile disassembly and reassembly.

SUMMARY OF THE INVENTION

The above and other objects which will become apparent to one skilled in the art upon a reading of this disclosure are attained by:

An assembly for a post-mixed spark-ignited burner comprising:

(A) an inner conduit having an inlet end and a discharge end;

(B) a housing axially along and circumferentially around the inner conduit and spaced from the inner conduit so as to define an annular passageway between the inner conduit and the housing;

(C) a chamber within the housing in flow communication with the inlet end of the inner conduit;

(D) a supply conduit communicating with the chamber and separate from the inlet end of the inner conduit;

(E) spaced electrically non-conductive seals, each circumferentially around the inner conduit between the inlet end and the discharge end, completely filling the annular space between the inner conduit and the housing in a radial direction; and (F) means to provide electrical potential to the inner conduit between the seals; whereby the inner conduit is securely fixed in position relative to and electrically isolated from, the housing by the seals, fluid provided to the chamber through the supply conduit is constrained by the insulators from mixing with fluid in the annular passageway, and forces acting on the supply conduit cannot be transmitted onto the inner conduit.

DETAILED DESCRIPTION

The burner assembly of this invention will be described in detail with reference to the drawings.

Figure 1:
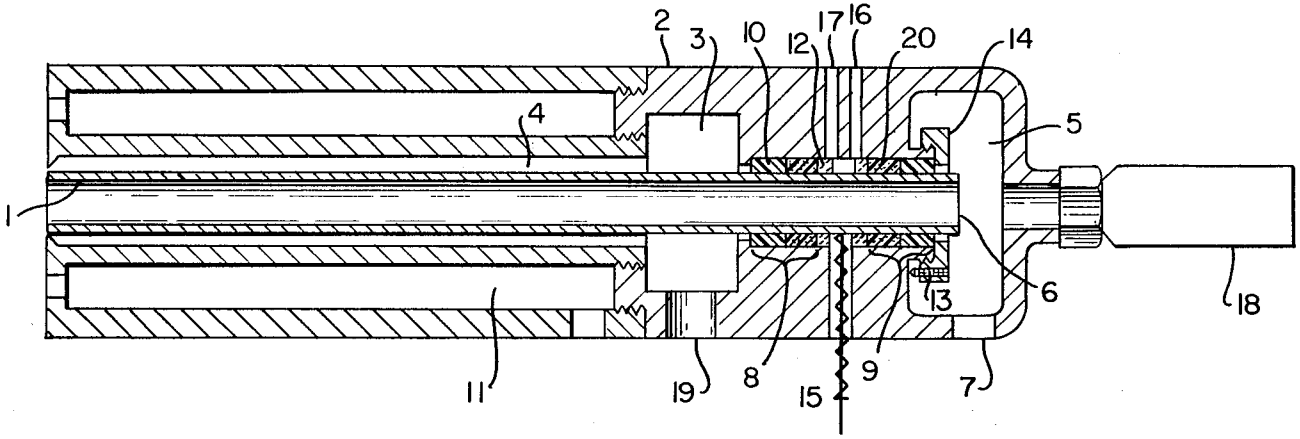
FIG. 1 is a cross-sectional view of one embodiment of the burner of this invention wherein the seals are separate pieces divided by a spacer.

Referring now to FIG. 1, inner conduit 1 is positioned within housing 2 which is axially along and circumferentially around inner conduit 1. The housing may be a unitary piece although it is preferably comprised of a plurality of pieces fastened together. The housing is spaced from the inner conduit so as to define an annular passageway 4 between the inner conduit and housing. The burner is a post-mixed burner wherein one fluid, either fuel or oxidant, flows in the inner conduit 1 and the other fluid flows through passageway 4. The fluids are kept separate from one another until they both exit out the discharge end of the burner where they are ignited. Although either fuel or oxidant may be carried in the inner conduit with the other fluid carried in the outer passageway, it is preferred that fuel be carried in the inner conduit and oxidant be carried in the outer passageway. The invention will be described in detail in accord with the preferred arrangement for fuel and oxidant. The burner shown in FIG. 1 is a preferred arrangement wherein a small annular stream of oxidant for flame stabilization purposes is supplied in addition to the main oxidant supply through passageway 11. This small annular oxidant stream is supplied through inlet 19 and chamber 3 to annular passageway 4.

Within housing 2 there is formed chamber 5 which is in fluid flow communication with the inlet end 6 of inner conduit 1. Also in fluid flow communication with chamber 5 is supply conduit 7 which is separate from and unconnected to inner conduit 1. Fuel supplied through conduit 7 to chamber 5 enters inner conduit 1 through inlet end 6 and proceeds through inner conduit 1 to the discharge end. Thus inner conduit 1 is completely unaffected by events occurring outside the burner which might cause its physical position or electrical isolation to be compromised. For example, movement of the supply conduit caused, for example, by contact with personnel or equipment, fluid pressure surges, etc., cannot be translated into force upon the inner conduit. The inner conduit must not be securely fastened to the outer housing by bolts or other such means because of the requisite electrical isolation. Thus even a relatively small force upon the inner conduit could cause movement of the inner conduit relative to the housing. Such movement could cause the spark ignition system to function improperly. The aforedescribed arrangement effectively delivers fuel to the inner conduit while ensuring that neither its physical position relative to, nor its electrical isolation from, the housing is compromised.

The inner conduit 1 is fixed in position within housing 2 and kept electrically isolated therefrom by means of spaced electrically non-conductive seals 8 and 9. These seals are positioned circumferentially around inner conduit 1 and completely fill the annular passageway in a radial direction between the inner conduit and the housing. The seals may have any axial length. However, a long axial length may be cumbersome. The arrangement shown in FIG. 1 is one preferred arrangement wherein the seals are separate and are each comprised of two pieces, a pusher ring 10 and a sealing ring 20. The seals are spaced by spacer insulation 12. By use of this arrangement internal set screw 13 secures locking ring 14 which in turn locks the seals 8 and 9 into place. The seals, thus locked into place, apply force radially outward and inward along their axial length. This force is applied directly to the housing 2 and inner conduit 1 so as to fix the position of the inner conduit relative to the housing.

The seals must be made of a material which is rigid enough to effectvely apply an effective fixing force to the inner conduit and the housing. The seals must also be electrically non-conductive. Examples for material suitable for seals are tetrafluoroethylene, carbon or glass filled tetrafluoroethylene, chlorosulfonated polyethylene, polyimide, nitrile rubber, nitrile-butadiene rubber, Viton TM, asbestos, butadiene-acrylo-nitrile, epichlorohydrin polymer rubber, chlorofluoro-ethylene polymer, methyl methacrylate, Polycarbonate TM, silicone rubber, polyethylene, Polysulfone TM, and most composites of two or more of the above.

The seals completely fill the annular passageway in a radial direction at points between the inner conduit inlet end 6 and the discharge end of the burner. In this way fuel from chamber 5 cannot flow in the annular passageway 4 past the seals and oxidant supplied to annular passageway 4 downstream of the seals cannot flow past the seals in the opposite direction. Thus the seals also serve the purpose of keeping fuel and oxidant from mixing within the burner.

Electrical potential is supplied to inner conduit 1 by any effective means such as the insulated electrical lead 15 illustrated in FIG. 1. It is important that the electrical potential be supplied to inner conduit 1 at a point between seals 8 and 9. In this way it is more certain that the electrical potential is supplied exclusively to inner conduit 1 and not to housing 2. Furthermore, this arrangement insures against hazard because neither fuel nor oxidant can flow into the area of electrical supply. Fuel is constrained by seal 9 and oxidant is constrained by seal 8 from flowing into this area. Furthermore, air which may be around the area of lead 15 is constrained from mixing with the fuel by virtue of the positioning of the lead between the spaced electrically non-conductive seals. It is recognized that either of seals 8 or 9 may, over time, deform slightly and oxidant or fuel at high pressure may leak past the seal. For this reason vent holes 16 and 17 are preferably provided which serve to detect leaks and vent the space. The placement of the electrical supply means between the seals significantly reduces hazard because it is extremely unlikely that both seals 8 and 9 would simultaneously leak and thus it is extremely unlikely that a mixture of fuel and oxidant would be formed in the area of electrical supply to the inner conduit.

A burner employing the burner assembly of this invention can be easily disassembled for cleaning, parts replacement, etc. One need only remove the back end flame detector 18 and remove the rear portion of housing 2. Set screw 13 is loosened and locking ring 14 is unlocked. Inner conduit 1 slides out and the inner parts become accessible. Reassembly is also easily done by reversing the procedure.

Figure 2:
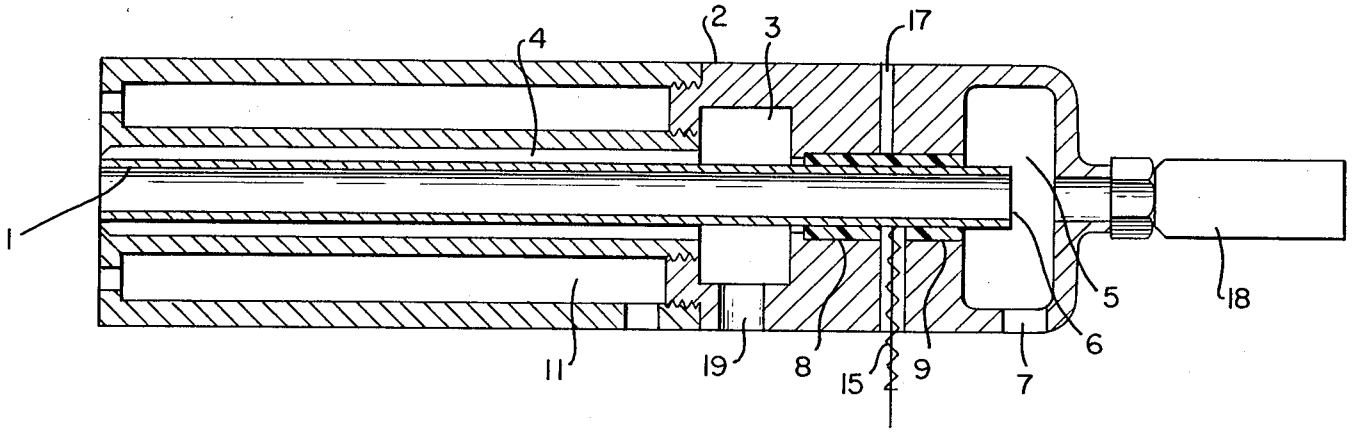
FIG. 2 is a cross-sectional view of another embodiment of the burner of this invention wherein the spaced seals are a unitary piece.

FIG. 2 is a representation of another embodiment of the burner of this invention wherein the spaced electrically non-conductive seals are part of a unitary piece with a space between the seals for passage of the electrical lead. In this arrangement only one vent hole is needed. The numerals of FIG. 2 correspond to those of FIG. 1. One convenient arrangement for the seals of FIG. 2 is the well-known configuration of solid material filling most of the annular space and one or more O-rings filling the remainder of the annular space.

In operation, electrical potential is supplied to inner conduit 1 by electrical supply means 15. Fuel is supplied to inner conduit 1 from supply conduit 7 and chamber 5 through inlet 6. Oxidant is supplied to annular passageway 4 through oxidant supply conduit 19. Fuel and oxidant flow separately through the burner to the discharge end. The electrified inner conduit and the grounded housing are spaced such that the lowest breakdown voltage between them is at the discharge end. This causes spark to arc from the electrically conductive inner conduit to the electrically conductive housing only at the discharge end. The spark ignites the fuel and oxidant. The assembly of this invention provides a means to insure that the spark occurs at the correct place. This is done in a manner which is relatively uncomplicated yet effectively prevents relative movement and electrical contact between the inner conduit and the housing. The assembly of this invention also reduces the chance of hazard due to unintentional mixing of fuel and oxidant. Furthermore, the assembly of this invention is easily disassembled and reassembled.

The burner of this invention may be used with a number of fuels and with any effective oxidant. However, this burner is most advantageously employed when the oxidant is relatively pure oxygen or oxygen-enriched air.

Claims:

1. An assembly for a post-mixed spark-ignited burner comprising (A) an inner conduit having an inlet end and a discharge end;

(B) a housing axially along and circumferentially around the inner conduit and spaced from the inner conduit so as to define an annular passageway between the inner conduit and the housing;

(C) a chamber within the housing in flow communication with the inlet end of the inner conduit;

(D) a supply conduit communicating with the chamber and separate from the inlet end of the inner conduit;

(E) spaced electrically non-conductive seals, each circumferentially around the inner conduit between the inlet end and the discharge end, each completely filling the annular space between the inner conduit and the housing in a radial direction; and (F) means to provide electrical potential to the inner conduit between the seals;

whereby the inner conduit is securely fixed in position relative to, and electrically isolated from, the housing by the seals, fluid provided to the chamber through the supply conduit is constrained by the seals from mixing with fluid in the annular passageway, and forces acting on the supply conduit cannot be transmitted onto the inner conduit.

2. The assembly of claim 1 wherein the seals are comprised of a pusher ring and a sealing ring.

3. The assembly of claim 1 wherein the seals are part of a unitary piece.

4. The assembly of claim 1 wherein the seals are a combination of solid material and O-rings.

5. The assembly of claim 1 wherein the seals are made of tetrafluoroethylene.

6. The assembly of claim 1 wherein the annular volume between the seals is vented to the atmosphere.

* * * * *